US006732410B1

(12) United States Patent
Nedderman, Jr.

(10) Patent No.: US 6,732,410 B1
(45) Date of Patent: May 11, 2004

(54) PRECISION HINGE MOUNTING STOPS

(75) Inventor: William H. Nedderman, Jr., Middletown, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/332,407

(22) Filed: Jun. 14, 1999

(51) Int. Cl.[7] ..... E05F 5/04
(52) U.S. Cl. ..... 16/374; 16/371; 16/375
(58) Field of Search ..... 16/371, 374, 375

(56) References Cited

U.S. PATENT DOCUMENTS

| | | | | | |
|---|---|---|---|---|---|
| 1,616,265 | A | | 2/1927 | Kroehling | |
| 1,903,251 | A | * | 3/1933 | Ahrens | 16/374 |
| 2,592,230 | A | | 4/1952 | Allen | |
| 3,325,854 | A | * | 6/1967 | Steigerwald | 16/371 |
| 4,831,688 | A | | 5/1989 | Deininger | |
| 5,027,471 | A | * | 7/1991 | Barnes | 16/374 |
| 5,661,875 | A | * | 9/1997 | Overcash et al. | 16/374 |
| 5,662,596 | A | | 9/1997 | Young | |
| 6,108,866 | A | * | 8/2000 | Waynick, Jr. | 16/374 |

* cited by examiner

*Primary Examiner*—Anthony Knight
*Assistant Examiner*—Enoch E. Peavey
(74) *Attorney, Agent, or Firm*—Michael J. McGowan; Robert W. Gauthier; Prithvi C. Lall

(57) ABSTRACT

To accurately and reproducibly set the angle of a hinge, especially a very small hinge, a precision hinge and angled mounting stops are provided. The device comprises a hinge joint having a fastener, such as a screw, connecting two bodies. A flat C-shaped mounting stop fits over the fastener and has two straight outer edges that contact each of the two bodies, respectively. The relative angle between the outer edges determines the set angle of the hinge.

15 Claims, 1 Drawing Sheet

PRECISION HINGE MOUNTING STOPS

STATEMENT OF GOVERNMENT INTEREST

The invention described herein may be manufactured and used by or for the Government of the United States of America for governmental purposes without payment of any royalties thereon or therefor.

BACKGROUND OF THE INVENTION (1) Field of the Invention

The present invention relates to a precision hinge apparatus. More particularly, the present invention is a novel apparatus for precision setting and maintaining of hinge angle positions with removable mounting stops.

(2) Description of the Prior Art

The prior art discloses devices having the purpose of limiting the swinging motion of a hinge.

For example, U.S. Pat. No. 2,592,230 to Allen discloses a door check for limiting the degree of open swing permitted by a door hinge. A pair of rectangular metal pieces are connected at a fixed angle to one another and attached to the hinge pintle such that they extend away from the hinge on the side opposite the hinge plates. As the hinged door swings open it reaches the point where the angle of the door to the wall equals the angle between the metal pieces, stopping further swing. The angular relationship between the pieces can be adjusted to change the maximum open swing of the door hinge.

U.S. Pat. No. 4,831,688 to Deininger discloses a door stop that prevents a door from closing. A support hook hangs over the top of a door hinge pintle supporting a horizontal wedge-shaped base that sits between open hinge plates. Door closing is prevented and the minimum open angle is determined by the size of the wedge.

U.S. Pat. No. 1,616,265 to Kroehling discloses a door stop that sits between the hinge plates of a door hinge to prevent complete door closing. A triangularly shaped metal strip fits as a wedge against the door hinge plates with an optional loop in the metal strip provided to secure the stop on the hinge pintle.

U.S. Pat. No. 5,662,596 to Young discloses an orthopedic hinge including stops that limit the range of hinge arm travel. The pivoting motion of a hinge arm relative to stationary front and back plates is obstructed at a certain position by a hinge stop placed in the arm's pivot path away from the hinge. The stop provides up to two settings for restricting motion.

Unfortunately, such devices are replete with shortcomings which make their teachings unsatisfactory for the purposes of the present invention. These include their inadabtability to precision applications, their failure to restrict swinging motion in two directions and their failure to allow setting of specific hinge positions. The present invention overcomes these and other limitations of the prior art devices.

SUMMARY OF THE INVENTION

It is a general purpose and object of the present invention to provide a precision hinge apparatus.

It is another object of the invention to provide an easy, accurate and adjustable way to maintain the fingers of a hinged joint at a fixed angle.

It is a further object of the invention to provide a hinge allowing accurate and reproducible fixed hinge settings by employing removable angled mounting stops.

It is a still further object of the invention to provide a precision hinge useful in small-scale development applications.

These objects and others are accomplished by the present invention which features a hinged joint connecting two bodies and at least one removable mounting stop that sets the angle between the fingers of the hinge. According to the invention, which is especially suited to small-scale applications where graduated hinge markings are impractical, the removable stop is inserted into the hinged joint with its edges abutting the connected bodies such that the angle between the two bodies is fixed. The relative angle between the edges determines the hinge angle.

The precision hinge of the present invention comprises a pair of overlapping fingers, each extending from one of the two connected bodies. A fastener extends through apertures in each of the fingers near their ends to pivotably connect them and their respective bodies. A slotted flat mounting stop fits over the fastener, preferably between the fingers and with its outer edges contacting the connected bodies. Preferably, a plurality of removable stops of various angular dimensions are included allowing the relative angle between the two bodies to be adjusted and set at any angle as desired.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein like numerals refer to like parts and wherein.

DESCRIPTION OF THE PREFERRED EMBODIMENT

Figure 1:
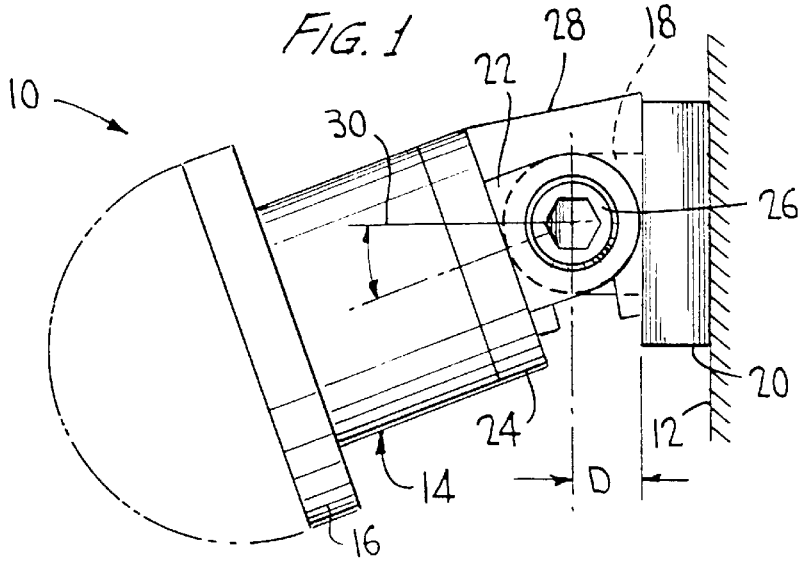
FIG. 1 is a side elevation of a hinge with a mounting stop according to the present invention.
Figure 2:
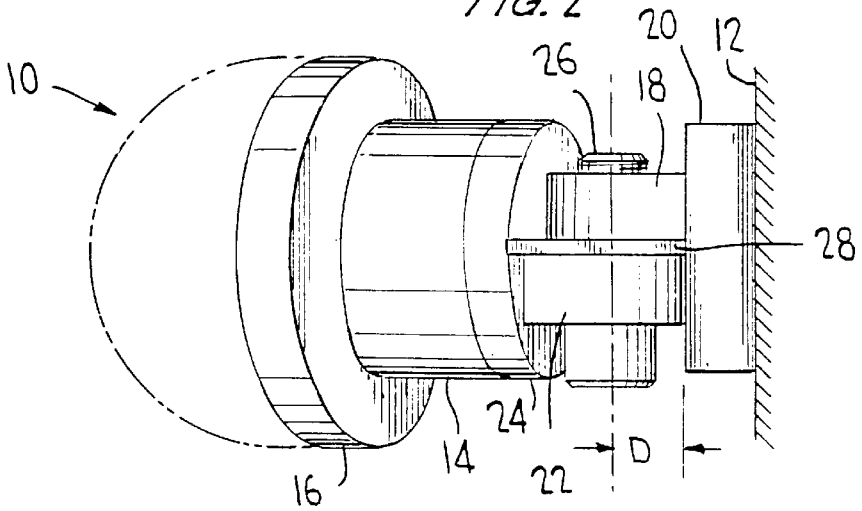
FIG. 2 is a plan view of the hinge and mounting stop of FIG. 1.

Referring to FIGS. 1 and 2, in accordance with the present invention, hinged joint 10 is shown connecting first and second bodies 12 and 14, respectively. First body 12 is fixed relative to adjustable second body 14 having hemispherical nose section 16. First finger 18 extends from first hinge base 20 orthogonal to the face of base 20. Similarly, second finger 22 extends from second hinge base 24. Fingers 18 and 22 have internally threaded apertures that receive fastening allen screw 26. Mounting stop 28 is sandwiched between fingers 18 and 22 fitting over screw 26, which passes through a slot in mounting stop 28. Each finger has the same length, creating a symmetrical hinge. This allows mounting stop 28 to be inserted in either of two orientations without changing the resulting hinge angle 30.

Figure 4:
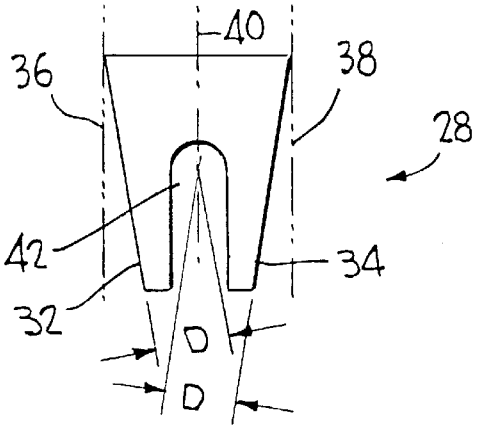
FIG. 4 is a mounting stop according to the present invention having non-parallel outer edges.

Referring now to FIGS. 1 and 4, the combined apparatus and the mounting stop 28 are shown, respectively. The angled outer straight edges 32 and 34 which abut first and second bases 20 and 24 determine the set angle 28 of the hinge. In mounting stop 28, the sum of the edge angles 36 and 38 relative to longitudinal axis 40 determines the hinge angle. For example, when the angles 36 and 38 of mounting stop 28 are each ten degrees, the resulting total hinge angle 30 is twenty degrees. Further, the distance D perpendicular to either of edges 32 or 34 to axis 40 of mounting stop 28 equals the distance from either of bases 20 or 24 to the center of screw 26. Central slot 42 permits mounting stop 28 to be inserted over screw 26. Screw 26 is tightened to fingers 18 and 22 securing mounting stop 28 and the selected hinge angle 30, twenty degrees in this case. The angles 36 and 38 of edges 32 and 34 of mounting stop 28 are equivalent, allowing easy insertion of mounting stop 28 without regard to its orientation.

Referring again to FIG. 2, a plan view of the apparatus of FIG. 1 is shown. In this view, it is more clearly seen that screw 26 securely fastens mounting stop 28 between fingers 18 and 22.

Figure 3:
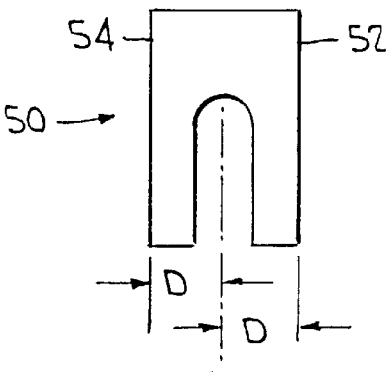
FIG. 3 is a mounting stop according to the present invention having parallel outer edges.

Referring now to FIG. 3, mounting stop 50 having parallel outer edges 52 and 54 is shown. When used as part of the present invention, the angle between the two connected bodies will be zero. It is understood that mounting stops can be manufactured according to the present invention with any desired edge angles.

In operation of the invention, screw 26 must be loosened to a point where the desired mounting stop, such as stop 28 or 50, can be inserted over it, between the fingers. Once retightened, with the angled outer edges of the mounting stop abutting the hinge bases, the hinge angle is securely and accurately set.

Those skilled in the art will appreciate the advantages of the current invention. The mounting stops provide for quick, accurate and repeatable hinge angle setting, without requiring graduation markings at the joint pivot. The stops are not prone to setting errors as a hinge with graduations would be. The invention can be practiced at any scale, especially with very small joints, where graduation markings are impracticable. The current invention, by avoiding complex components, further lends itself to small-scale applications, especially, for example, torpedo development models wherein the angle of attack must be accurately and reproducibly adjusted.

In light of the above, it is therefore understood that within the scope of the following claims, the invention may be practiced otherwise than as specifically described.

What is claimed is:

1. A precision hinge apparatus comprising:

first and second opposing fingers, each having a longitudinal axis, a hinge end with an aperture, and a distal end, said fingers overlapping at said hinge ends with said apertures in alignment;

a fastener having a longitudinal axis extending through said apertures and connecting said fingers near said hinge ends;

first and second hinge bases each having a substantially flat contact surface attached to said first and second distal ends, respectively; and a removable mounting stop symmetrical in shape about its longitudinal axis comprising a flat, slotted C-shaped fork having straight upper and lower edges, said slot extending from one of two side edges to the interior of said stop and said slot fitting over said fastener, perpendicular to said fastener longitudinal axis with said upper and lower edges abutting said first and second bases, respectively, and maintaining said hinge immovably at a desired angle while said stop is in place.

2. The claim of apparatus 1 wherein said slot has two parallel edges connected by a semi-circular trough in said interior.

3. The apparatus of claim 2 wherein said slot fits over said fastener between said first and second fingers such that said stop is sandwiched between said fingers.

4. The apparatus of claim 3 wherein said contact surfaces are substantially perpendicular to said first and second finger longitudinal axes, respectively.

5. The apparatus of claim 4 wherein said upper and lower edges extend along said contact surfaces, respectively, on both sides of said finger distal ends, respectively.

6. The apparatus of claim 5 wherein said fastener is substantially equidistant from said first and second bases.

7. The apparatus of claim 6 wherein said upper and lower edges are not parallel.

8. The apparatus of claim 7 wherein said fastener has an adjustment head and a threaded extension and said apertures are internally threaded.

9. The apparatus of claim 8 further comprising a plurality of interchangeable said stops, wherein the angle between said upper and lower edges differs among stops.

10. The apparatus of claim 1 wherein said slot fits over said fastener between said first and second fingers such that said stop is sandwiched between said fingers.

11. The apparatus of claim 1 wherein said contact surfaces are substantially perpendicular to said first and second finger longitudinal axes, respectively.

12. The apparatus of claim 1 wherein said upper and lower edges extend along said contact surfaces, respectively, on both sides of said finger distal ends, respectively.

13. The apparatus of claim 1 wherein said fastener is substantially equidistant from said first and second bases.

14. The apparatus of claim 1 wherein said upper and lower edges are not parallel.

15. The apparatus of claim 1 further comprising a plurality of interchangeable said stops, wherein the angle between said upper and lower edges differs among stops.

* * * * *